US010246953B2

(12) United States Patent
Gonzalez

(10) Patent No.: US 10,246,953 B2
(45) Date of Patent: Apr. 2, 2019

(54) SYSTEM FOR DISASSEMBLING COMPONENTS OF A DRILL STRING

(71) Applicant: CATERPILLAR GLOBAL MINING EQUIPMENT LLC., Denison, TX (US)

(72) Inventor: Fernando Rene Gonzalez Gonzalez, Sherman, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 119 days.

(21) Appl. No.: 15/422,713

(22) Filed: Feb. 2, 2017

(65) Prior Publication Data

US 2018/0216425 A1 Aug. 2, 2018

(51) Int. Cl.
*E21B 19/18* (2006.01)
*E21B 19/16* (2006.01)

(52) U.S. Cl.
CPC ..... *E21B 19/18* (2013.01); *E21B 19/161* (2013.01)

(58) Field of Classification Search
CPC ..... E21B 19/18; E21B 19/146; E21B 19/161; E21B 19/167
See application file for complete search history.

(56) References Cited

U.S. PATENT DOCUMENTS

| | | | | |
|---|---|---|---|---|
| 2,668,689 | A * | 2/1954 | Cormany | E21B 19/16 81/56 |
| 3,985,189 | A | 10/1976 | Jahnke et al. | |
| 4,495,840 | A | 1/1985 | Freitag et al. | |
| 4,862,959 | A | 9/1989 | Kaven | |
| 4,924,954 | A | 5/1990 | Mead | |
| 6,164,391 | A | 12/2000 | Wurm | |
| 8,424,419 | B2 | 4/2013 | Connell | |
| 2002/0062717 | A1 * | 5/2002 | Stogner | E21B 19/18 81/57.16 |
| 2010/0071958 | A1 * | 3/2010 | Bienfang | E21B 19/146 175/85 |
| 2015/0315859 | A1 | 11/2015 | Strydom | |

* cited by examiner

*Primary Examiner* — Cathleen R Hutchins
(74) *Attorney, Agent, or Firm* — Oblon, McClelland, Maier & Neustadt

(57) ABSTRACT

A system for disassembling components of a drill string includes a primary wrench, a secondary wrench, and a bit removal basket. The primary wrench has a pair of jaws in which at least one of the jaws is moveable in relation to the other. The secondary wrench is disposed at a position lower than the primary wrench and is configured to define a pair of beveled faces that are adapted to restrict a rotational movement of at least one component of the drill string. The bit removal basket is disposed at a position lower than the secondary wrench. The bit removal basket is configured to define an opening therethrough. A shape of the opening is configured to correspond with profiles of at least two types of drill bits, one of the at least two types of drill bits being present for use in the drill string.

20 Claims, 6 Drawing Sheets

SYSTEM FOR DISASSEMBLING COMPONENTS OF A DRILL STRING

TECHNICAL FIELD

The present disclosure relates to a drill string. More particularly, the present disclosure relates to a system and a method for disassembling components of a drill string.

BACKGROUND

It is well known in the art to use a drill rig for performing a drilling operation in the earth's surface. There are many types of drill configurations that can be used on a drill rig for performing the drilling operation. Some examples of drill string configurations that may be implemented for use with the drill rig may include, but is not limited to, a tri-cone drill configuration, or a down-the-hole (DTH) drill configuration. It is known to persons skilled in the art that each of the drill configurations may include components that are similar or dissimilar to components from the other drill string configurations. In an example, the tri-cone drill may include a tri-cone bit, a bit sub-adaptor, a drill pipe, a top sub-adaptor, and a shock-sub while in another example, the DTH drill may include a bit, a hammer, a bit sub-adaptor, a hammer-cum-drill pipe, a top sub-adaptor, and a shock-sub.

U.S. Publication 2015/0315859 discloses a system for accomplishing disassembly of components present in a drill string. However, the system of the '859 publication employs numerous tools for performing the disassembly. Moreover, a manner of operation associated with the system of the '859 publication may be tedious, cumbersome and time-consuming.

In addition, it has been observed that in many cases, conventional drill rigs are typically designed for use with a single type or configuration of drill string therewith. Accordingly, tools present on such conventional drill rigs are also provided to accomplish assembly or disassembly of the single type or configuration of drill string that is designated for use with the drill rig. However, in some cases, manufacturers may be desirous of producing a drill rig that can interchangeably accommodate drill bits from multiple drill configurations. In such cases, it may be required to consequently provide tools that are compatible for use with components associated with each type of drill string from the multiple drill string configurations.

Further, it has also been observed that for installation of tools typically present on conventional drill rigs, an amount of space required is significantly large. When mounted on a deck of a drill rig, such large amount of space may often be at a premium due to other considerations, such as to allow room for facilitating movement of the tools or installation of other components of the drill rig.

Hence, there is a need for a simple, compact, and cost-effective system that is designed to facilitate quick and easy assembly or disassembly of drill strings from multiple drill string configurations.

SUMMARY OF THE DISCLOSURE

In an aspect of the present disclosure, a system for disassembling components of a drill string includes a primary wrench, a secondary wrench, and a bit removal basket. The primary wrench is swivelably supported on a mast and is located at a fixed height along the mast. The primary wrench has a pair of jaws wherein at least one of the jaws is moveable in relation to the other. The secondary wrench is disposed in an opposing relation to the primary wrench and is adjustable in height relative to the primary wrench. The secondary wrench is configured to define a pair of beveled faces thereon. The pair of beveled faces are adapted to restrict a rotational movement of at least one component of the drill string vis-à-vis a pair of flat surfaces present on the at least one component of the drill string. The bit removal basket is disposed at a position lower than the secondary wrench. The bit removal basket is configured to define an opening therethrough. A shape of the opening is configured to correspond with profiles of at least two types of drill bits, one of the at least two types of drill bits being present for use in the drill string.

In another aspect of the present disclosure, a method for disassembling components a drill string includes locating a primary wrench at a height corresponding to a clamping zone of at least one component of the drill string. The method further includes locating a secondary wrench at a height lower than the height of the primary wrench. The method further includes providing a bit removal basket at a height lower than a position of the secondary wrench, the bit removal basket defining an opening configured to correspond with profiles of at least two types of drill bits, one of the at least two types of drill bits being present for use in the drill string. If disassembly of at least one of the two types of drill bits from the at least one component is desired, then the method includes operably rotating the at least one component relative to the at least one of the two types of drill bits using the primary wrench while the at least one of the two types of drill bits is rotationally restricted in the opening of the bit removal basket. If disassembly of a pair of components from one another is desired, then the method includes operably rotating a first one of the components relative to a second one of the components using the primary wrench while the second one of the components is rotationally restricted by the secondary wrench.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
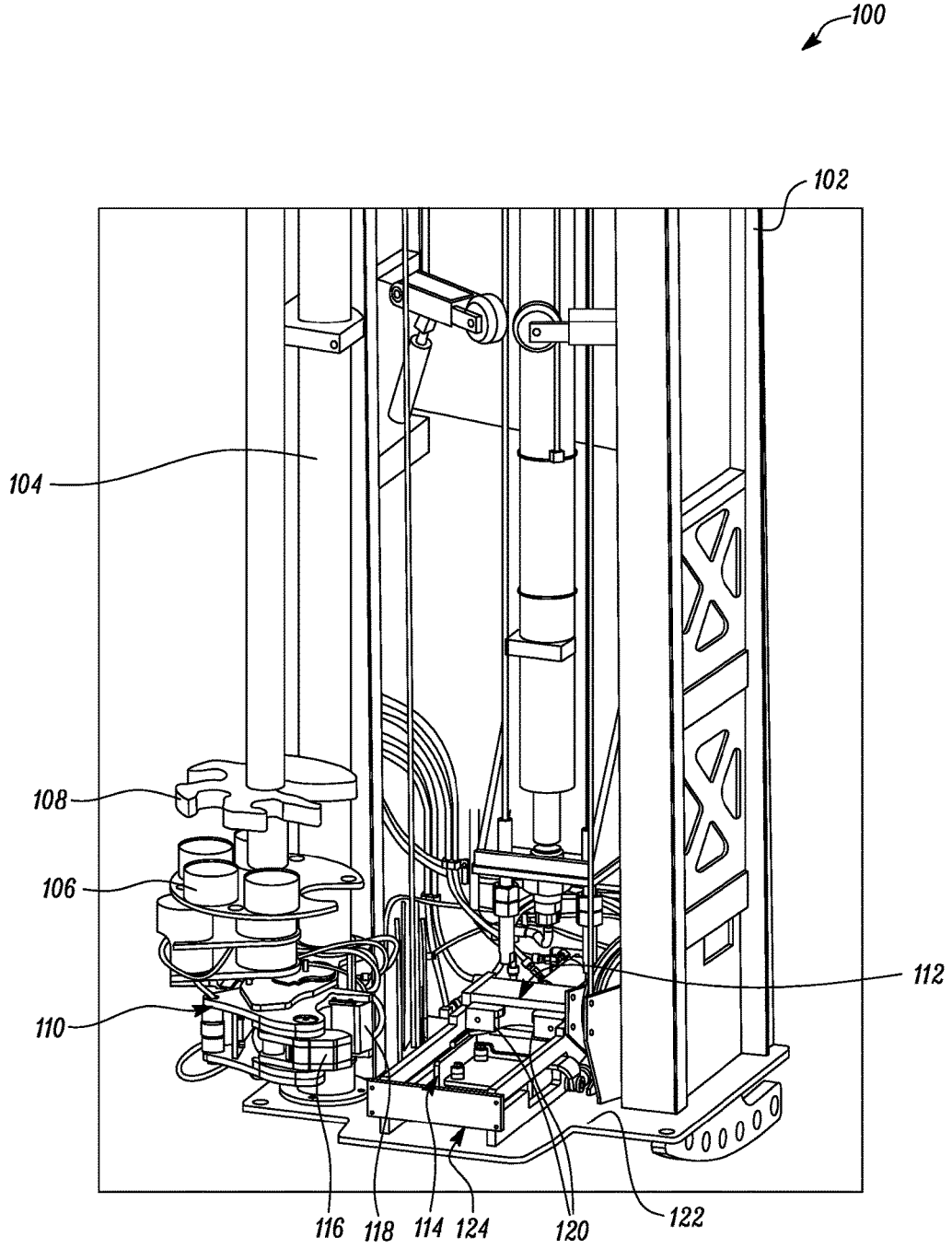
FIG. 1 is a perspective view of a system for disassembling components of a drill string, in accordance with an embodiment of the present disclosure.

FIG. 1 illustrates a system 100 for disassembling components of a drill string 300/400 (shown in FIGS. 3-4), in accordance with an embodiment of the present disclosure. The system 100 may be implemented for use on a mobile machine (not shown), for example, a blast hole drill rig or a water well drill rig that has locomotive ground engaging elements such as wheels or tracks (not shown), or a stationary machine which may be exemplarily implemented by way of an offshore drill rig (not shown). As shown in FIG. 1, the system 100 may be associated with a frame 102 for supporting various components of the system 100 explanation to which will be made in detail later herein.

Figures 3, 4, 5:
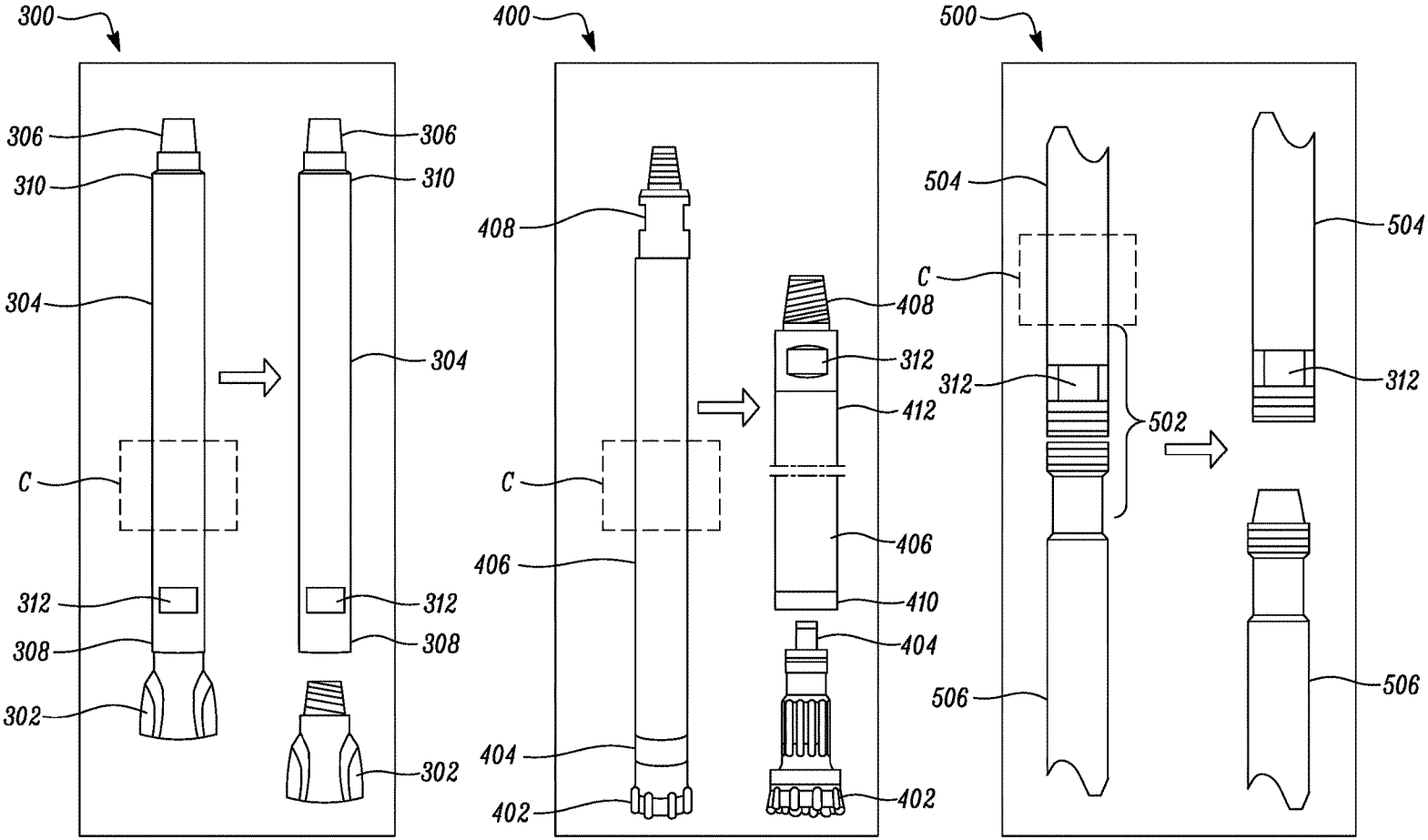
FIGS. 3-5 are views depicting disassembly of different configurations of drill strings, in accordance with various embodiments of the present disclosure.

Referring to FIGS. 3-4, two configurations of drill strings 300/400 are shown, namely—a tri-cone drill 300 and a down-the-hole (DTH) drill 400. As shown in FIG. 3, the tri-cone drill 300 may include a tri-cone bit 302, at least one component which in this configuration is a drill pipe 304, and a top sub-adaptor 306. The tri-cone bit 302 can be threadably engaged to a bottom end 308 of the drill pipe 304 while the top sub-adaptor 306 can be threadably engaged to a top end 310 of the drill pipe 304.

As shown in FIG. 4, the DTH drill 400 may include a hammer bit 402, a bit sub-adaptor 404, at least one component which in this configuration is a hammer-cum-drill pipe 406, and a top sub-adaptor 408. The hammer bit 402 can be threadably engaged to the bit sub-adaptor 404 which in turn can be threadably engaged to a bottom end 410 of the hammer-cum-drill pipe 406. As is the case with the tri-cone drill 300, the top sub-adaptor 408 in this case can likewise be threadably engaged to a top end 412 of the hammer-cum-drill pipe 406. Although various components of respective ones of the tri-cone drill 300 and the DTH drill 400 are disclosed herein, it will be acknowledged by persons skilled in the art that the tri-cone drill 300 and the DTH drill 400 may, additionally or optionally, include other components depending on specific requirements of a drilling application.

Referring back to FIG. 1, a mast 104 may be supported by the frame 102. The mast 104 is configured to rotatably support a pipe rack 106 and a carousel 108 which facilitates a positioning of at least component of the drill string 300/400 which may be a drill pipe 304 (as shown in FIG. 3) or a hammer-cum-drill pipe 406 (as shown in FIG. 4) depending on a type or configuration of the drill string 300/400 being implemented for use in a drilling application.

Figure 2:
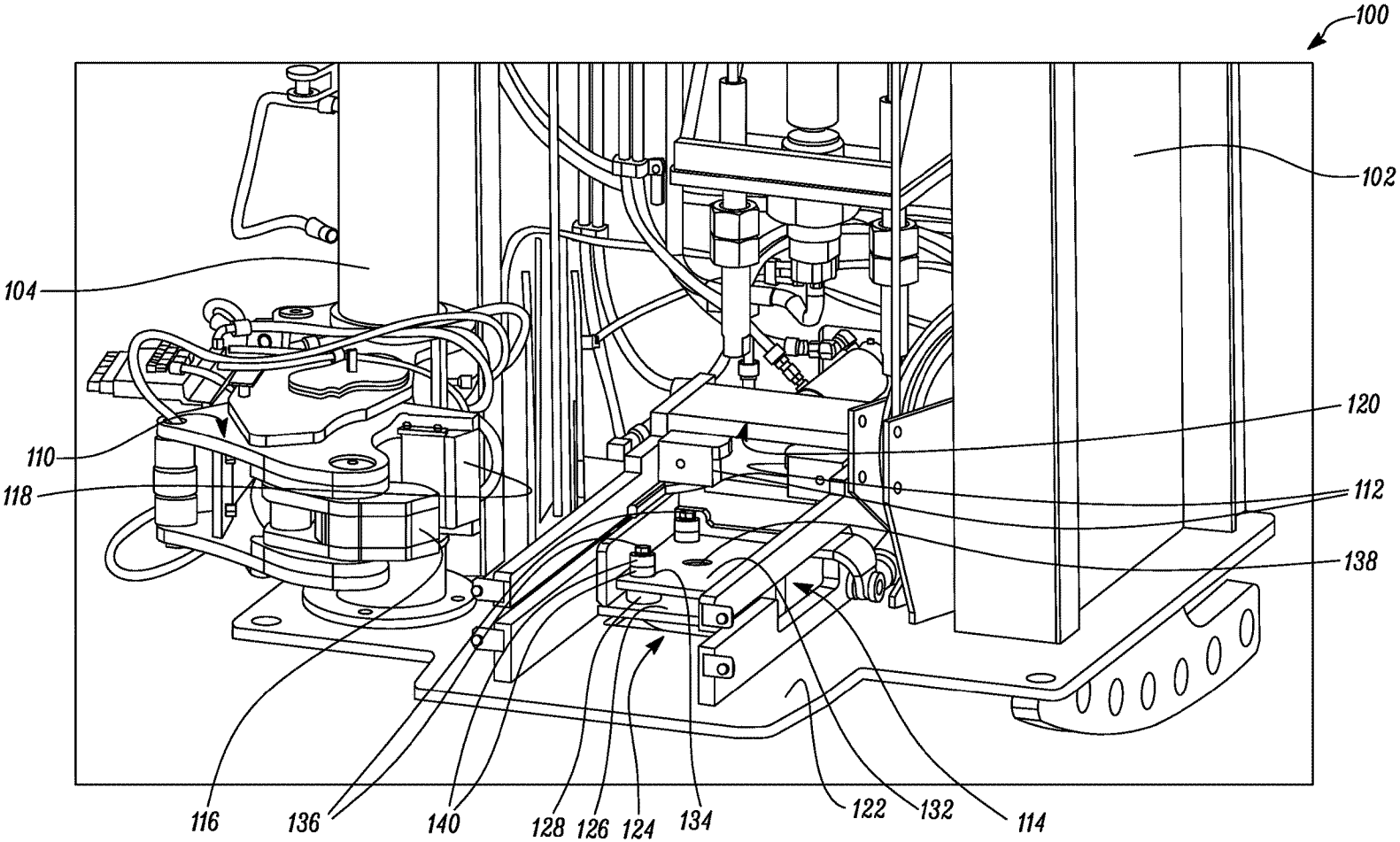
FIG. 2 is an enlarged view of the system from FIG. 1.

With reference to FIGS. 1 and 2, the system 100 includes a primary wrench 110, a secondary wrench 112, and a bit removal basket 114. The primary wrench 110 is swivelably supported on the mast 104. The primary wrench 110 has a pair of jaws 116, 118 wherein at least one of the jaws 116, 118 is moveable in relation to the other. In addition, it may be noted that the primary wrench 110 is located at a height corresponding to a clamping zone C (shown in FIGS. 3 and 4) of the at least one component of the drill string 300/400 which as disclosed earlier herein can include one of the drill pipe 304 or the hammer-cum-drill pipe 406 depending on a type or configuration of the drill string used i.e., the tri-cone drill 300 or the DTH drill 400.

It may be noted that the 'clamping zone' disclosed herein is also applicable to other portions 500 of the drill string 300/400 such as a pipe-to-pipe connection 502 of the tri-cone drill 300 or the DTH drill 400 which, in an embodiment of this disclosure, is exemplarily shown in FIG. 5. In embodiments of this disclosure, it has been contemplated that if the primary wrench 110 is located at a height that is common to the clamping zones C of each of the drill pipe 304, the hammer-cum-drill pipe 406, and a first one of the drill pipes 504 from the pipe-to-pipe connection 502 that could be present in either one of the drill strings i.e., the tri-cone drill 300 or the DTH drill 400, then the primary wrench 110 could advantageously remain fixed in position. As translational movement of the primary wrench 110 along the mast 104 of the drill rig is avoided, a stability of the drill rig is improved and more space is available for installation and operation of other components located in the vicinity of the mast 104. In an example, as shown in FIG. 1, with absence of the translational movement of the primary wrench 110 along the mast 104, the pipe rack 106 and the carousel 108 which are generally heavy components of the drill rig would not entail movement along the mast 104 and hence, advantageously remain at a fixed position along the mast 104.

The secondary wrench 112 is disposed in an opposing relation to the primary wrench 110. Additionally, the secondary wrench 112 is located at a position lower than the primary wrench 110. The secondary wrench 112 is configured to define a pair of beveled faces 120 thereon. The pair of beveled faces 120 are adapted to restrict a rotational movement of at least one component of the drill string 300/400 vis-à-vis a pair of flat surfaces 312 present on the at least one component of the drill string 300/400 which as shown in FIGS. 3 and 4, is present on the drill pipe 304 and the hammer-cum-drill pipe 406 respectively. As the views of FIGS. 3 and 4 is taken from a side facing one of the flat surfaces 312, only one flat surface 312 is visible in respective ones of the drill pipe 304 and the hammer-cum-drill pipe 406 shown in FIGS. 3 and 4 respectively. However, it should be noted that an identical flat surface is additionally disposed on an opposing side of the pipe and such identical flat surface would be visible if the views of FIGS. 3-4 were rendered from a perspective standpoint.

The bit removal basket 114 is disposed at a position lower than the secondary wrench 112. In an embodiment as shown in FIGS. 1 and 2, the system 100 further includes a deck 122. The deck 122 may form part of the drill rig or may be implemented as a stand-alone platform that is separate from a main deck (not shown) of the drill rig by any means known in the art. In the illustrated embodiment of FIGS. 1 and 2, the deck 122 is configured to define a guideway 124 thereon. The guideway 124 is configured to slidably bear the bit removal basket 114 therein. The bit removal basket 114 is therefore operably moveable in the guideway 124 between a standby position and a bit removal position.

Figure 6:
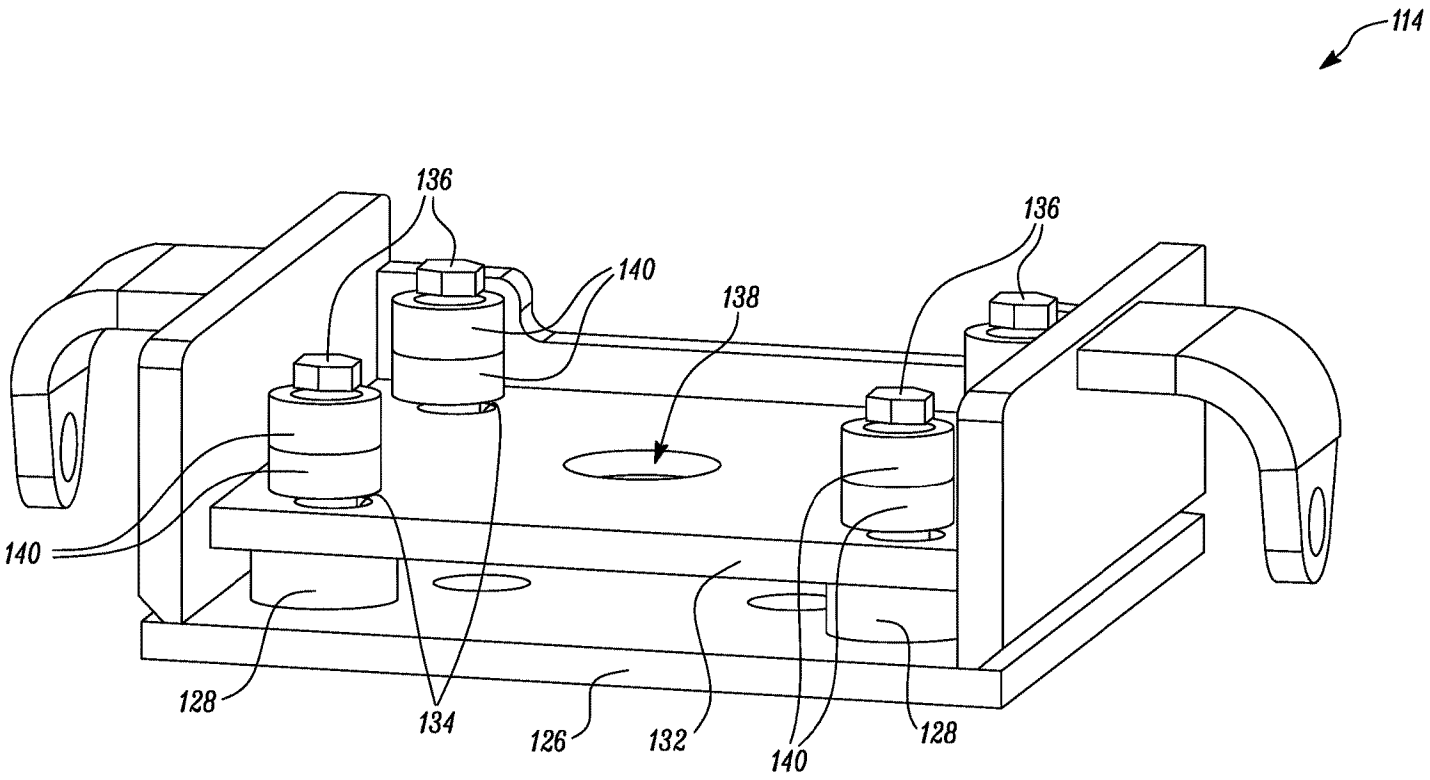
FIG. 6 is a perspective view of a bit removal basket of the system, in accordance with an embodiment of the present disclosure.
Figure 7:
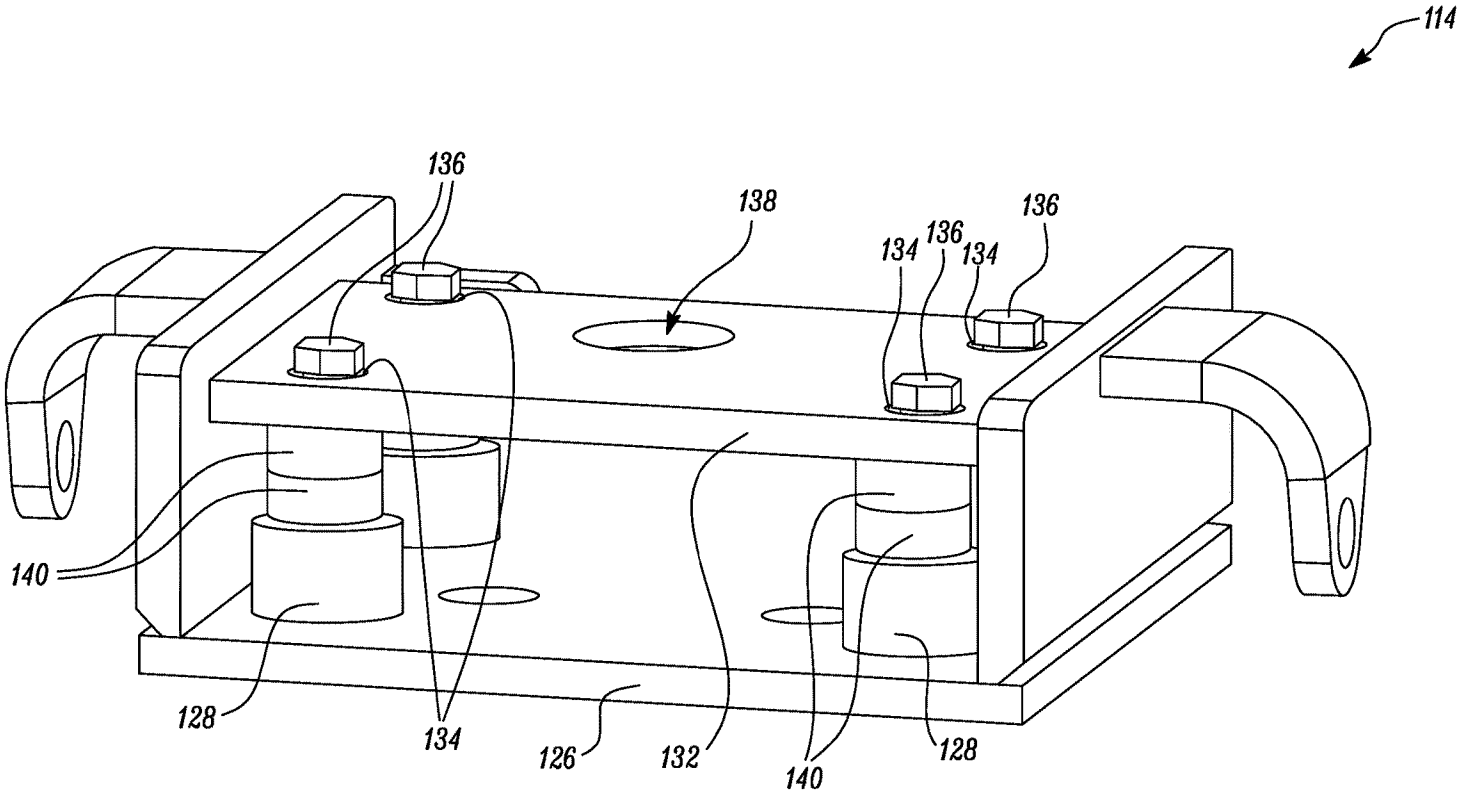
FIG. 7 is a perspective view of a bit removal basket shown in a configuration different from the configuration depicted in FIG. 6.

In the illustrated embodiment of FIGS. 2, 6 and 7, the bit removal basket 114 includes a baseplate 126, and a plurality of bosses 128 disposed on the baseplate 126. Each of the bosses 128 is configured to define a threaded receptacle (not shown) longitudinally therethrough. The bit removal basket 114 further includes a bit removal plate 132 that defines a plurality of holes 134 corresponding to the plurality of bosses 128. The bit removal plate 132 is secured to the plurality of bosses 128 with the help of a plurality of fasteners 136 for e.g., bolts that can threadably engage with the threaded receptacles defined by the plurality of bosses 128.

The bit removal basket 114 is configured to define an opening 138 therethrough. In the particular embodiment of FIGS. 2, 6, and 7, the opening 138 provided by the bit removal basket 114 is more particularly defined by the bit removal plate 132 in which a shape of the opening 138 is configured to correspond with profiles of at least two types of drill bits, one of the at least two types of drill bits being present for use in the drill string 300/400 i.e., the tri-cone bit 302 or the hammer bit 402 depending on whether the tri-cone drill 300 or the DTH drill 400 is used in a given drilling application.

Additionally, referring to FIGS. 2, 6, and 7, the bit removal basket 114 includes at least one spacer 140 slidably disposed about each of the bosses 128. As shown in the illustrated embodiments of FIGS. 2, 6, and 7, two spacers 140 are disposed about each of the bosses 128. However, in other embodiments, fewer or more spacers 140 may be used depending on specific requirements of an application. It may be noted that a number of spacers 140 disposed about each of the bosses 128 may be maintained equal in use to advantageously facilitate an interchangeable positioning of the bit removal plate 132 in one of above the spacers 140 or below the spacers 140 about each of the bosses 128.

Referring to FIG. 6, when the bit removal plate 132 is positioned below the spacers 140 associated with each of the bosses 128, the opening 138 of the bit removal plate 132 corresponds with a profile of a first type of drill bit e.g., the tri-cone bit 302 for restricting a rotational movement of the first type of drill bit such that the bit removal plate 132 can be used to disassemble the first type of drill bit from the at least one component of the drill string 300/400 i.e., the drill pipe 304 of the tri-cone drill 300.

Referring to FIG. 7, when the bit removal plate 132 is positioned above the spacers 140 associated with each of the bosses 128, the opening 138 of the bit removal plate 132 corresponds with a profile of a second type of drill bit e.g., the hammer bit 402 for restricting a rotational movement of the second type of drill bit such that the bit removal plate 132 can be used to disassemble the second type of drill bit from the at least one component of the drill string 300/400 i.e., the hammer-cum-drill pipe 406 of the DTH drill 400.

In embodiments of this disclosure, it has been contemplated that the secondary wrench 112 is disposed lower in position than the primary wrench 110 and would be configured to generally remain fixed in such lower position than the primary wrench 110. However, in other embodiments, it is alternatively contemplated that in order to correspond with a position of the flat surfaces 312 from the drill pipe 304, the hammer-cum-drill pipe 406, or the second one of the drill pipes 506 from the pipe-to-pipe connection 502 in which the flat surfaces 312 could shift by a small distance along an axis of the drill string 300/400 during operation of the drill rig, the secondary wrench 112 could be slidably supported on the frame 102 so that when such variation in the position of the flat surfaces 312 occurs from one component to another or one type of component to another, the secondary wrench 112 can easily be adjusted in height relative to the primary wrench 110 to coincide or correspond with the position of the flat surfaces 312 and when engaged with the flat surfaces 312, restrict the given component from the rotating about its respective axis.

Figure 8:
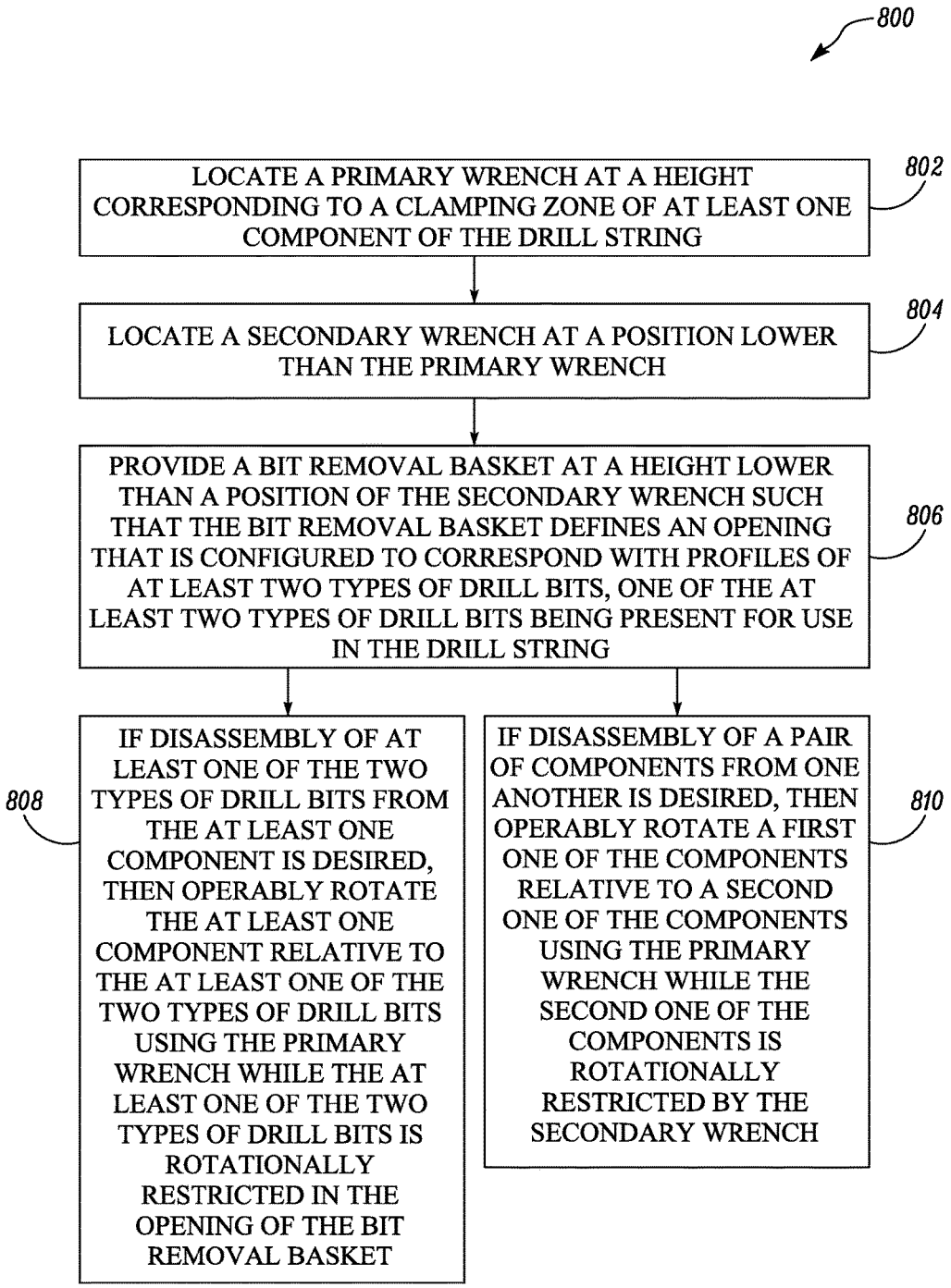
FIG. 8 is a flowchart of a method for disassembling components of a drill string, in accordance with an embodiment of the present disclosure.

FIG. 8 illustrates a flowchart of a method 800 for disassembling components of the drill string 300/400. At step 802, the method 800 includes locating the primary wrench 110 at a height corresponding to the clamping zone C of at least one component of the drill string 300/400. At step 804, the method 800 further includes locating a secondary wrench 112 at a height lower than the height of the primary wrench 110. At step 806, the method 800 further includes providing a bit removal basket 114 at a height lower than a position of the secondary wrench 112, the bit removal basket 114 defining an opening 138 configured to correspond with profiles of at least two types of drill bits, one of the at least two types of drill bits being present for use in the drill string 300/400.

If disassembly of at least one of the two types of drill bits from the at least one component i.e., i.e., the tri-cone bit 302 from the drill pipe 304 or the hammer bit 402 from the hammer-cum-drill pipe 406 is desired, then at step 808, the method 800 includes operably rotating the at least one component i.e., the drill pipe 304 or the hammer-cum-drill pipe 406 using the primary wrench 110 relative to the at least one of the two types of drill bits i.e., the tri-cone bit 302 or the hammer bit 402 while the at least one of the two types of drill bits i.e., the tri-cone bit 302 or the hammer bit 402 is rotationally restricted in the opening 138 of the bit removal basket 114.

If disassembly of a pair of components i.e., the first drill pipe 504 from a second one of the drill pipes 506 is desired (see FIG. 5), then at step 810, the method 800 includes operably rotating a first one of the components relative to a second one of the components i.e., the first drill pipe 504 relative to the second drill pipe 506 using the primary wrench 110 while the second one of the components i.e., the second drill pipe 506 is rotationally restricted by the secondary wrench 112.

Various embodiments disclosed herein are to be taken in the illustrative and explanatory sense, and should in no way be construed as limiting of the present disclosure. All directional references (e.g., top, bottom, above, below, lower) are only used for identification purposes to aid the reader's understanding of the present disclosure, and may not create limitations, particularly as to the position, orientation, or use of the system and/or method disclosed herein. Moreover, all joinder references (e.g., attached, affixed, joined, abut, associated, connected, and the like) are only used to aid the reader's understanding of the present disclosure, and may not create limitations, particularly as to the position, orientation, or use of the system and/or method disclosed herein. Therefore, joinder references, if any, are to be construed broadly. Moreover, such joinder references do not necessarily infer that two elements are directly connected to each other.

Additionally, all numerical terms, such as, but not limited to, "primary", "secondary", "first", "second", "third" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional components, such features may be omitted from the scope of the present disclosure without departing from the spirit of the present disclosure as defined in the appended claims.

INDUSTRIAL APPLICABILITY

When disassembly of the tri-cone bit 302 or the hammer bit 402 from the pipe 304/406 is desired, the bit removal basket 114 is moved into the bit removal position (as shown in FIG. 2) for use with the primary wrench 110. The jaws 116, 118 of the primary wrench 110 then co-operate to grip the clamping zone C of the pipe 304/406 and rotate the clamped pipe 304/406 relative to the tri-cone bit 302 or the hammer bit 402 that is rotationally restricted in the opening 138 of the bit removal plate 132. As torque is applied to the clamping zone C vis-à-vis the pair of jaws 116, 118 and the clamped pipe 304/406 rotates relative to the rotationally restricted tri-cone bit 302 or the hammer bit 402, the threaded engagement of the pipe 304/406 with the tri-cone bit 302 or the hammer bit 402 becomes disengaged with one another.

When disassembly of the first one of the pipes 504 from the second one of the pipes 506 in the pipe-to-pipe connection 502 is desired, the bit removal basket 114 may be allowed to remain in the bit removal position (as shown in FIG. 2) as the bit removal basket 114 does not interfere with movement of the drill strings 300/400 or the portion 500 of the drill string 300/400 that includes the pipe-to-pipe connection 502. Alternatively, the bit removal basket can be moved into the standby position which is located at the fore of the guideway 124 as opposed to the bit removal position in which the bit removal basket 114 is located (at the aft of the guideway 124) as shown in FIG. 2. To accomplish a disengagement of the first one of the pipes 504 from the second one of the pipes 506 in the pipe-to-pipe connection 502, the jaws 116, 118 of the primary wrench 110 co-operate to grip the clamping zone C of the first pipe 504 and rotate the clamped first pipe 504 relative to the second pipe 506 that is rotationally restricted by the secondary wrench 112 upon abutment of the beveled faces 120 with the pair of flat surfaces 312 on the first pipe 504. As torque is applied to the clamping zone C vis-à-vis the pair of jaws 116, 118 and the clamped pipe 504 rotates relative to the rotationally restricted second pipe 506, the threaded engagement of the first pipe 504 with the second pipe 506 become disengaged with one another.

From the foregoing, it is evident that embodiments of the present disclosure have applicability for use and implementation in disassembling components of a drill string. Although two types of drill string configurations i.e., the tri-cone drill 300 and the DTH drill 400 are disclosed herein, it may be noted that the system 100 of the present disclosure can also be suitably applied to numerous other types of structurally equivalent drill string configurations known to persons skilled in the art. Moreover, although the present disclosure has been explained in reference to disassembly of components or portions of a drill string 300/400/500, it should be noted that the system 100 of the present disclosure can also be used for assembling the various components or portions of a drill string 300/400/500.

As the two wrenches 110 and 112 of the system 100 do not move along a height of the frame 102 and the mast 104 respectively, and only the bit removal plate 132 of the bit removal basket 114 is rendered with a height adjustability feature, the system 100 of the present disclosure is rendered in a compact configuration and utilizes less space than most traditionally designed arrangements known for disassembling components of a drill string. Also, the compact configuration and space claim of the present system 100 facilitates additional room for installation and operation of numerous other components of a drill rig in the vicinity of the frame 102 and/or the mast 104 if required. Further, with implementation of the system 100 disclosed herein, components of a drill string can be assembled or disassembled quickly thereby facilitating operators or technicians of drill rigs to reduce time and effort in accomplishing an assembly or disassembly of components required in a drill string.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A system for disassembling components of a drill string, the system comprising:

a primary wrench swivelably supported on a mast and located at a fixed height along the mast, the fixed height corresponding to a clamping zone of the drill string, the primary wrench further having a pair of jaws wherein at least one of the jaws is moveable to engage and disengage the drill string at the clamping zone, wherein the primary wrench is swivelable about the mast between a first position and a second position different from the first position;

a secondary wrench disposed in an opposing relation to the primary wrench and adjustable in height relative to the primary wrench, the secondary wrench defining a pair of beveled faces thereon, the pair of beveled faces adapted to restrict a rotational movement of at least one component of the drill string by abutment of the pair of beveled faces with a pair of flat gripping surfaces located on the at least one component of the drill string; and a bit removal basket disposed at a position lower than the secondary wrench, the bit removal basket defining an opening therethrough, wherein a shape of the opening is configured to correspond with profiles of a plurality of different configurations of drill bits, wherein the plurality of different configurations of drill bits includes at least a first drill bit of a first configuration and a second drill bit of a second configuration different from the first configuration, and one of the first and second drill bits being present for use in the drill string, wherein the first position of the primary wrench is a standby position of the primary wrench and the second position of the primary wrench is a bit removal position of the primary wrench for the primary wrench to engage the drill string at the clamping zone.

2. The system of claim 1, wherein the secondary wrench is located at a position lower than the primary wrench.

3. The system of claim 1 further comprising a deck configured to define a guideway thereon, the guideway configured to slidably bear the bit removal basket therein.

4. The system of claim 3, wherein the bit removal basket is linearly slidable in the guideway between a standby position of the bit removal basket and a bit removal position of the bit removal basket.

5. The system of claim 1, wherein the bit removal basket includes:

a baseplate;

a plurality of bosses disposed on the baseplate, each of the bosses defining a threaded receptacle longitudinally therethrough; and a bit removal plate defining a plurality of holes corresponding to the plurality of bosses, the bit removal plate secured to the plurality of bosses with the help of a plurality of fasteners threadably engaged with the threaded receptacles of the plurality of bosses.

6. The system of claim 5, wherein the bit removal basket includes at least one spacer slidably disposed about each of the bosses, wherein a number of spacers used on each of the bosses is equal to one another.

7. The system of claim 6, wherein the bit removal plate is interchangeably positionable in one of: above and below the at least one spacer.

8. The system of claim 7, wherein, when the bit removal plate is positioned below the at least one spacer, the opening of the bit removal plate corresponds with a profile of the first drill to restrict a rotational movement of the first drill bit such that the bit removal plate is configured for use in disassembling the first drill bit from the at least one component of the drill string.

9. The system of claim 7, wherein, when the bit removal plate is positioned above the at least one spacer, the opening of the bit removal plate corresponds with a profile of the second drill bit to restrict a rotational movement of the second drill bit such that the bit removal plate is configured for use in disassembling the second drill bit from the at least one component of the drill string.

10. The system of claim 1, further comprising a bit removal plate removably coupled to the bit removal basket, the bit removal plate being adjustable in a vertical direction to a first fixed height and to a second fixed height below the first fixed height, wherein the bit removal basket is linearly slidable only in a first plane according to a first direction and a second direction opposite the first direction between a standby position of the bit removal plate and a bit removal position of the bit removal plate, wherein the first and second directions are perpendicular to the vertical direction.

11. The system of claim 10, wherein the at least one component of the drill string includes one of: a drill pipe and a hammer-cum-drill pipe.

12. A method for disassembling components of a drill string, the method comprising:

locating a primary wrench at a fixed height corresponding to a clamping zone of at least one component of the drill string, wherein the primary wrench is swivelable about a mast between a first position and a second position different from the first position;

locating a secondary wrench at a position lower than the primary wrench; and providing a bit removal basket at a height lower than a position of the secondary wrench, the bit removal basket defining an opening configured to correspond with profiles of a plurality of different configurations of drill bits, including a first drill bit of a first configuration and a second drill bit of a second configuration different from the first configuration, and one of the first and second drill bits being present for use in the drill string, wherein:

when disassembly of said one of the first and second drill bits from the at least one component is desired, then operably rotating the at least one component relative to said one of the first and second drill bits using the primary wrench while said one of the first and second drill bits is rotationally restricted in the opening of the bit removal basket; and when disassembly of a pair of components from one another is desired, then operably rotating a first one of the components relative to a second one of the components using the primary wrench while the second one of the components is rotationally restricted by the secondary wrench, wherein the first position of the primary wrench is a standby position and the second position of the primary wrench is a bit removal position for the primary wrench to engage the at least one component of the drill string at the clamping zone.

13. The method of claim 12, wherein a pair of jaws associated with the primary wrench is operably moveable to grip the at least one component of the drill string at the clamping zone.

14. The method of claim 12, wherein the bit removal basket is directly below the primary wrench when the primary wrench is in the bit removal position.

15. The method of claim 14, wherein the secondary wrench is disposed in an opposing relation to the primary wrench and is adjustable in height relative to the primary wrench, the secondary wrench defining a pair of beveled faces thereon, the pair of beveled faces adapted to restrict a rotational movement of the at least one component of the drill string by abutment of the pair of beveled faces with a pair of flat gripping surfaces located on the at least one component of the drill string.

16. The method of claim 12, wherein the bit removal basket is configured to include:

a baseplate;

a plurality of bosses disposed on the baseplate, each of the bosses defining a threaded receptacle longitudinally therethrough; and a bit removal plate defining a plurality of holes corresponding to the plurality of bosses, the bit removal plate secured to the plurality of bosses with the help of a plurality of fasteners threadably engaged with the threaded receptacles of the plurality of bosses.

17. The method of claim 16, wherein the bit removal basket includes at least one spacer slidably disposed about each of the bosses, wherein a number of spacers used between each of the bosses is equal to one another.

18. The method of claim 17 further comprising positioning the bit removal plate in one of: above and below the at least one spacer.

19. The method of claim 18, wherein, when the bit removal plate is positioned below the at least one spacer, the opening of the bit removal plate corresponds with a profile of the first drill bit to restrict a rotational movement of the first drill bit such that the bit removal plate is configured for use in disassembling the first drill bit from the at least one component of the drill string, and wherein, when the bit removal plate is positioned above the at least one spacer, the opening of the bit removal plate corresponds with a profile of the second drill bit to restrict a rotational movement of the second drill bit such that the bit removal plate is configured for use in disassembling the second drill bit from the at least one component of the drill string.

20. The method of claim 12, wherein, when the primary wrench is in the standby position the primary wrench does not overlap the bit removal basket in a vertical direction.

* * * * *